US011635227B2

(12) United States Patent
Zhou et al.

(10) Patent No.: US 11,635,227 B2
(45) Date of Patent: Apr. 25, 2023

(54) OPENING AND CLOSING DEVICE, AIR DUCT ASSEMBLY AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Junhua Zhou, Foshan (CN); Shengchang Hu, Foshan (CN); Jiajun Wang, Foshan (CN); Huoxu Huang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 556 days.

(21) Appl. No.: 16/801,749

(22) Filed: Feb. 26, 2020

(65) Prior Publication Data

US 2021/0164687 A1 Jun. 3, 2021

Related U.S. Application Data

(63) Continuation of application No. PCT/CN2019/125236, filed on Dec. 13, 2019.

(30) Foreign Application Priority Data

Nov. 29, 2019 (CN) ..... 201911207054.4
Nov. 29, 2019 (CN) ..... 201911207077.5
(Continued)

(51) Int. Cl.
*F24F 13/12* (2006.01)
*F24F 1/028* (2019.01)
*F24F 11/00* (2018.01)

(52) U.S. Cl.
CPC ..... *F24F 13/12* (2013.01); *F24F 1/028* (2019.02); *F24F 2011/0002* (2013.01)

(58) Field of Classification Search
CPC .... F24F 1/028; F24F 2011/0002; F24F 13/12; F24F 1/02; F24F 1/027; F24F 13/1426; F24F 13/08; F24F 13/10
(Continued)

(56) References Cited

U.S. PATENT DOCUMENTS 4,205,597 A * 6/1980 Nawa ..... F24F 1/031 62/262
5,056,333 A * 10/1991 Cho ..... F24F 1/027 62/262
(Continued)

FOREIGN PATENT DOCUMENTS

CA 3009068 A1 6/2017
CN 207081116 U 3/2018
(Continued)

OTHER PUBLICATIONS

World Intellectual Property Organization (WIPO) International Search Report and Written Opinion for PCT/CN2019/125236 dated Jul. 14, 2020 19 Pages.

*Primary Examiner* — Edelmira Bosques
*Assistant Examiner* — Brett Peterson Mallon
(74) *Attorney, Agent, or Firm* — Anova Law Group PLLC

(57) ABSTRACT

An opening and closing device includes a door cover including a vent and an opening and closing member configured to be inserted into the door cover through an opening of the vent along an extension direction of the vent. The opening and closing member includes an air door and is
(Continued)

movable between an open position at which the air door does not close the vent and a closed position at which the air door closes the vent.

19 Claims, 12 Drawing Sheets

(30) Foreign Application Priority Data

Nov. 29, 2019 (CN) ..... 201922131452.4
Nov. 29, 2019 (CN) ..... 201922132865.4

(58) Field of Classification Search
USPC ..... 62/262, 427; 454/202
See application file for complete search history.

(56) References Cited

U.S. PATENT DOCUMENTS 6,000,234 A * 12/1999 Baek ..... F24F 1/027 62/262
6,571,570 B1 * 6/2003 Phillips ..... F24F 1/027 62/262

FOREIGN PATENT DOCUMENTS

CN 109579148 A 4/2019
CN 109764415 A 5/2019
CN 109764416 A 5/2019
KR 0170841 B1 * 3/1999 ..... F24F 1/027
SE 540810 C2 11/2018

* cited by examiner

OPENING AND CLOSING DEVICE, AIR DUCT ASSEMBLY AND AIR CONDITIONER

CROSS-REFERENCE TO RELATED APPLICATIONS

This application is a continuation of International Application No. PCT/CN2019/125236, filed on Dec. 13, 2019, which claims priority to Chinese Patent Application Serial Nos. 201922132865.4, 201911207054.4, 201911207077.5 and 201922131452.4, filed with the National Intellectual Property Administration of P. R. China on Nov. 29, 2019, the entire contents of all of which are incorporated herein by reference.

FIELD

The present application relates to the field of air conditioning technologies, and particularly to an opening and closing device, an air duct assembly having the opening and closing device, and an air conditioner having the air duct assembly.

BACKGROUND

Some of air conditioners in a related art are provided with fresh air ducts, and thus an air door structure is required to open and close the fresh air duct, so as to receive fresh air selectively, thereby optimizing an indoor environment effectively, and improving a heat exchange effect and an environmental comfort.

However, the air door structure in the related art is inconvenient to assemble, which affects a production efficiency of the air conditioner greatly. Further, there is a limited mounting space at a rear side of an indoor unit of the air conditioner (especially a window air conditioner), which not only is difficult to mount an air door, but also easily causes a damage in a process of mounting the air door.

SUMMARY

An object of the present application is to provide an opening and closing device which is convenient to mount and use, simplifies assembly effectively, increases an assembly efficiency and reduces an assembly cost.

Another object of the present application is to provide an air duct assembly having the opening and closing device.

Still another object of the present application is to provide an air conditioner having the air duct assembly.

An opening and closing device according to an embodiment of the present application includes: a door cover provided with a vent extending in a front and rear direction; and an opening and closing member connected with the door cover and movable between an open position and a closed position, and inserted to the door cover from front to rear, where the opening and closing member comprises an air door, and the vent is opened by the air door when the opening and closing member is in the open position, and the vent is closed by the air door when the opening and closing member is in the closed position.

In the opening and closing device according to embodiments of the present application, the combination of the door cover and the opening and closing member may modularize the opening and closing device and facilitate production, assembly and design of an opening and closing door decoration. In addition, the opening and closing member may be mounted to the door cover from front to rear, thereby simplifying an assembly process of the opening and closing member, increasing the assembly efficiency and reducing a loss.

In addition, the opening and closing device according to the above-mentioned embodiment of the present application may further have the following additional technical features.

In some embodiments, the air door includes: a closing member configured to close over and open the vent; and an insertion member connected with the closing member, and inserted into the vent from front to rear and nested in the vent and movable in the front and rear direction.

In some embodiments, the insertion member includes: a first insert connected with the closing member and extending backwards; and a second insert connected with the closing member and extending backwards, where the first and second inserts are spaced apart in a first direction perpendicular to the front and rear direction.

In some embodiments, the first and second inserts are inserted at two opposite sides in the vent in the first direction correspondingly.

In some embodiments, a width of the first insert in a second direction is equal to a width of the vent, and the second direction is perpendicular to the first direction and the front and rear direction.

In some embodiments, the second insert includes a first portion connected with the closing member and extending backwards; and a second portion connected with the first portion and extending backwards, where a width of the first portion in the second direction is equal to the width of the vent, a width of the second portion in the second direction is less than the width of the vent, and the second direction is perpendicular to the first direction and the front and rear direction.

In some embodiments, the first insert has a shape of flat plate.

In some embodiments, the second insert has a shape of hollow tube extending in a second direction perpendicular to the first direction and the front and rear direction.

In some embodiments, the door cover further includes a guide opening with an axis extending in the front and rear direction, and the opening and closing member further includes a guide member inserted into the guide opening from front to rear and nested in the guide opening and movable in the front and rear direction, the guide member being connected with the air door.

In some embodiments, the door cover exhibits a shape of tube extending in the front and rear direction, a rear end of the door cover is open and has a wedge-shaped structure, and the vent and the guide opening are spaced apart in a direction perpendicular to the front and rear direction and are provided at a front end of the door cover.

In some embodiments, the opening and closing member is provided with a limit member abutting against a front side of the door cover when the opening and closing member is located in the closed position.

In some embodiments, the opening and closing member further includes a pull rod connected with the air door and extending forwards, and an end of the pull rod away from the door cover is provided with a handle perpendicular to the pull rod.

An air duct assembly according to an embodiment of the present application includes: an air duct casing having an air circulation duct and a fresh air duct formed therein, and being provided with an air supply outlet communicated with an air return inlet of the air circulation duct; a fan wheel provided in the air circulation duct; and the above-mentioned opening and closing device mounted to the air duct casing and configured to open and close the fresh air duct.

In some embodiments, a bottom surface of the air supply outlet includes a first step surface, a second step surface and a connection surface connected between the first and second step surfaces, the first step surface being higher than the second step surface to form a step, and an outlet of the fresh air duct being provided at the first step surface.

In some embodiments, the first step surface is configured as an arc surface with a depth reduced gradually in a direction away from the second step surface.

In some embodiments, the air circulation duct is configured to be inclined away from the fresh air duct, in a direction from the air return inlet to the air supply outlet.

In some embodiments, the fan wheel is configured to be rotated away from the fresh air duct, in the direction from the air return inlet to the air supply outlet.

In some embodiments, the fresh air duct runs through the air duct casing in the front and rear direction, the air circulation duct extends in a longitudinal direction, the air supply outlet has a closed rear side and an open front side and is used to supply air, the air supply outlet is configured into a shape extending in a transverse direction, the fresh air duct is arranged at a transverse end of the air supply outlet, and the transverse direction, the longitudinal direction, and the front and rear direction are perpendicular to one another.

In some embodiments, the door cover is nested in the fresh air duct, and the opening and closing member is mounted to the door cover from front to rear.

In some embodiments, the air duct casing includes: a rear air duct provided with a fresh air inlet and the air circulation duct; and a front air duct provided at a front side of the rear air duct and provided with a fresh air outlet and an air guide opening, where the fresh air outlet and the fresh air inlet are opposite in the front and rear direction and construct the fresh air duct, and the air guide opening and an air outlet end of the air circulation duct are opposite in the front and rear direction and construct the air supply outlet.

In some embodiments, a part of the opening and closing device is provided in the fresh air inlet to open and close the fresh air inlet.

In some embodiments, the opening and closing device is configured to be mounted into the fresh air inlet from a front side of the fresh air inlet.

In some embodiments, the door cover is nested in the fresh air inlet, and the opening and closing member is mounted to the door cover from front to rear.

In some embodiments, a flow area of the fresh air outlet is smaller than that of the fresh air inlet.

In some embodiments, the opening and closing member in the open position abuts against a rear side of the front air duct.

In some embodiments, the air duct casing may further include a cover plate covering the front side of the rear air duct to close over the air circulation duct, the air return inlet being formed at the cover plate.

In some embodiments, the air duct assembly further includes an air outlet frame connected with the air duct casing and opposite to the air supply outlet, the opening and closing device including a pull rod extending to be adjacent to the air outlet frame but not extending out of the air outlet frame.

In some embodiments, an end of the pull rod close to the air outlet frame is provided with a handle perpendicular to the pull rod.

An air conditioner according to an embodiment of the present application includes: the above-mentioned air duct assembly; and a heat exchanger provided at the air circulation duct.

In some embodiments, the opening and closing member in the open position abuts against a rear side of the heat exchanger.

Figure 1:
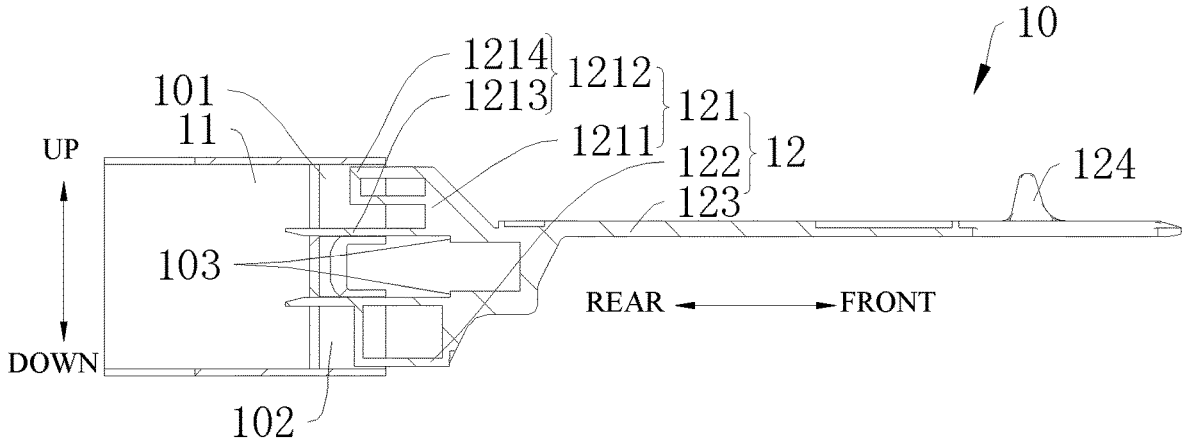
FIG. 1 is a cross-sectional view of an opening and closing device according to one embodiment of the present application.

REFERENCE NUMERALS air conditioner 1000;

air duct assembly 100; opening and closing device 10; door cover 11; opening and closing member 12; vent 101; air door 121; closing member 1211; insertion member 1212; first insert 1213; second insert 1214; first portion 1215; second portion 1216; guide opening 102; guide member 122; limit member 103; pull rod 123; handle 124; air duct casing 20; air circulation duct 201; fresh air duct 202; air return inlet 203; air supply outlet 204; fan wheel 23; air outlet frame 24; rear air duct 21; front air duct 22; fresh air inlet 205; fresh air outlet 206; air guide opening 207; cover plate 25; first step surface 208; second step surface 209; connection surface 2010; heat exchanger 300.

DETAILED DESCRIPTION

Reference will be made in detail to embodiments of the present application, and the examples of the embodiments are illustrated in the drawings, where the same or similar elements and the elements having same or similar functions are denoted by like reference numerals throughout the descriptions. The embodiments described herein with reference to drawings are illustrative, and merely intended for explaining the present application. The embodiments shall not be construed to limit the present application.

Figure 2:
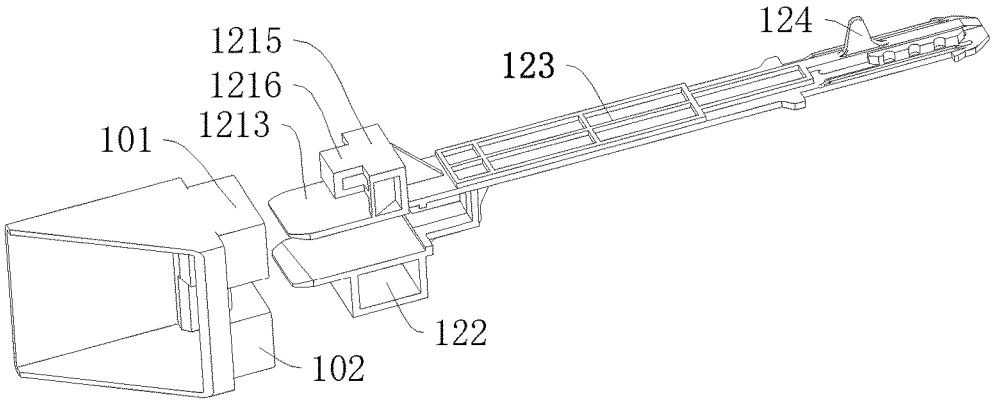
FIG. 2 is a schematic exploded diagram of the opening and closing device according to one embodiment of the present application.
Figure 3:
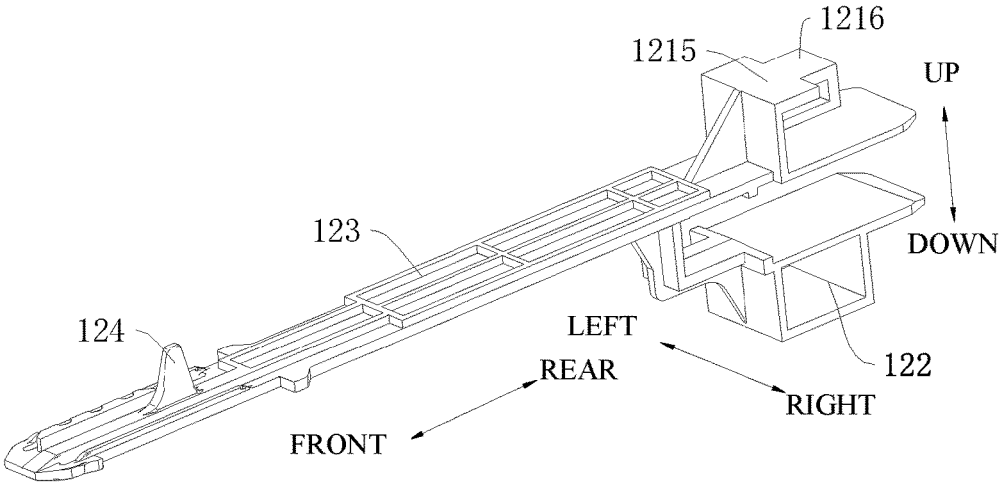
FIG. 3 is a schematic diagram of an opening and closing member of the opening and closing device according to one embodiment of the present application.
Figure 4:
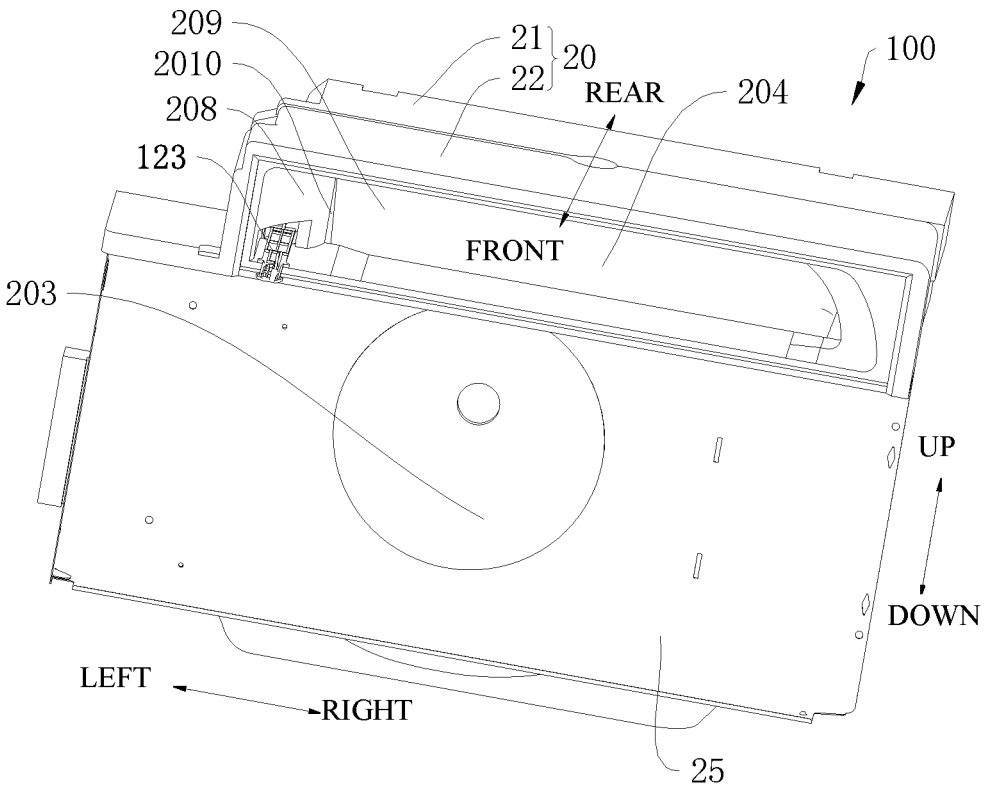
FIG. 4 is a schematic diagram of an air duct assembly according to one embodiment of the present application.
Figure 5:
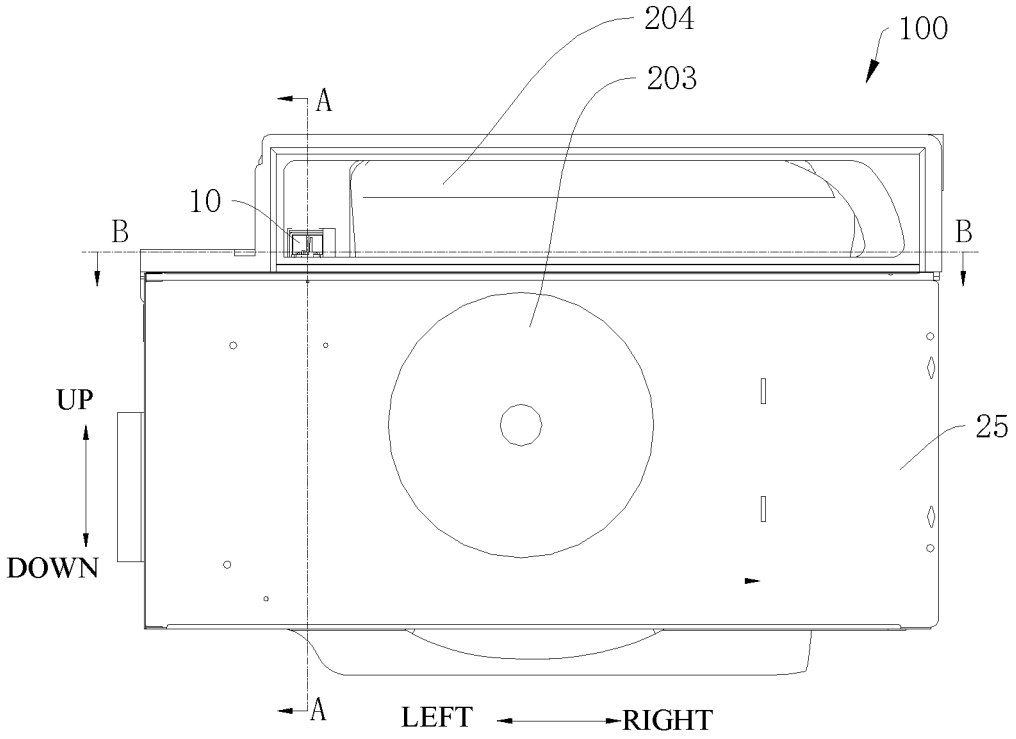
FIG. 5 is a front view of the air duct assembly according to one embodiment of the present application.
Figure 6:
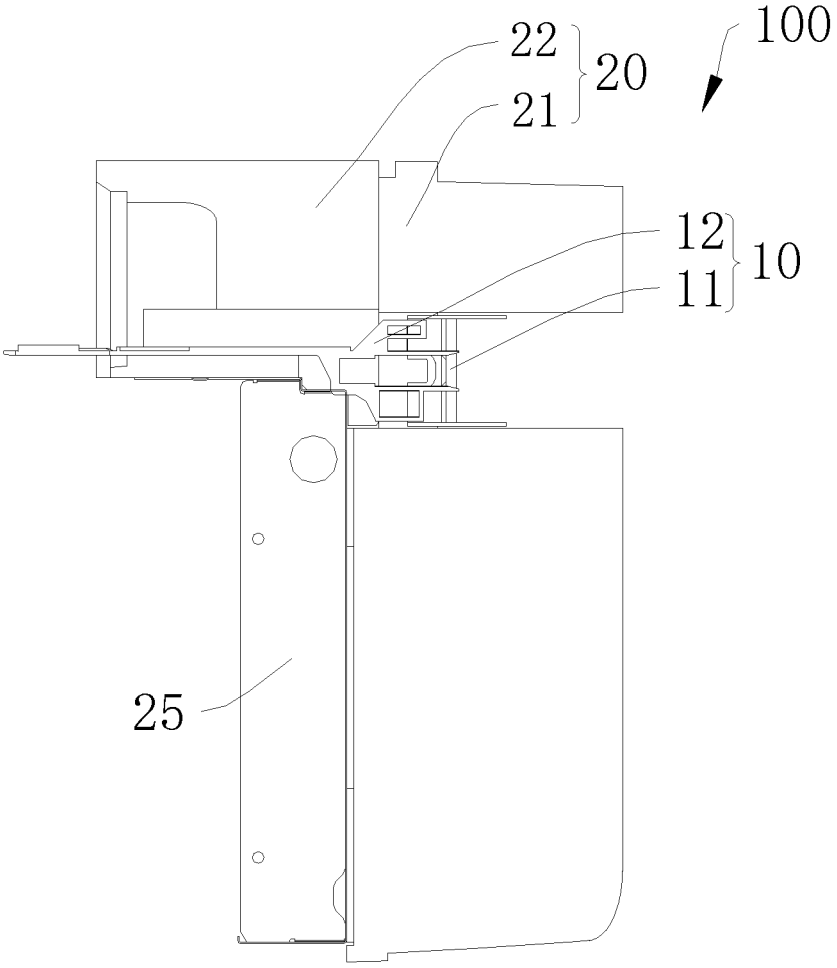
FIG. 6 is a cross-sectional view along line A-A in FIG. 5.
Figure 7:
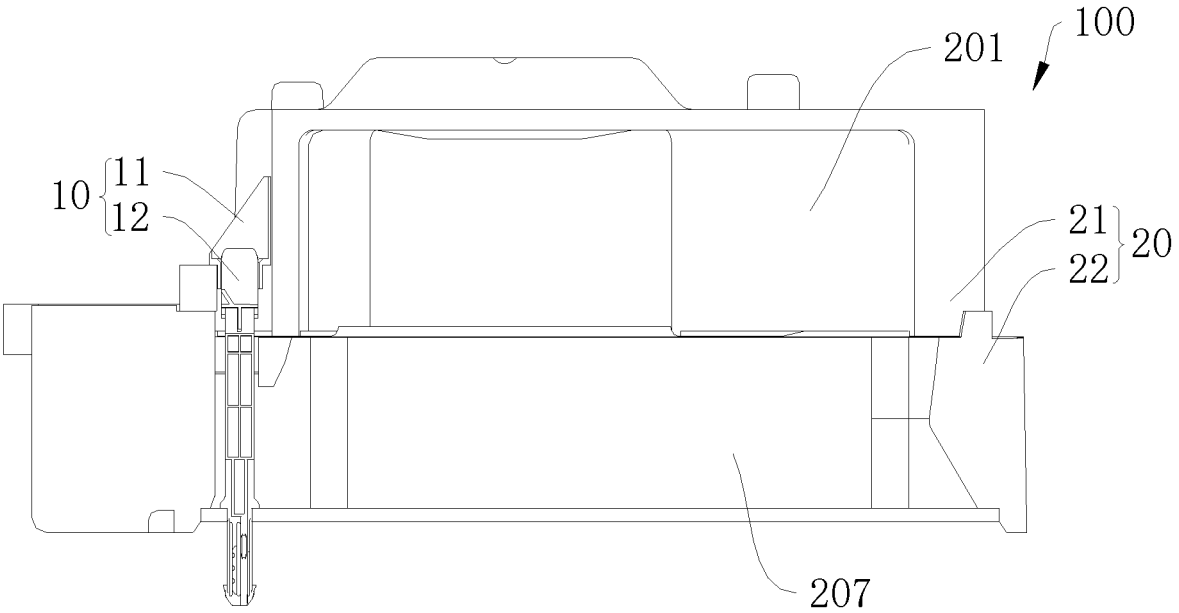
FIG. 7 is a cross-sectional view along line B-B in FIG. 5.
Figure 8:
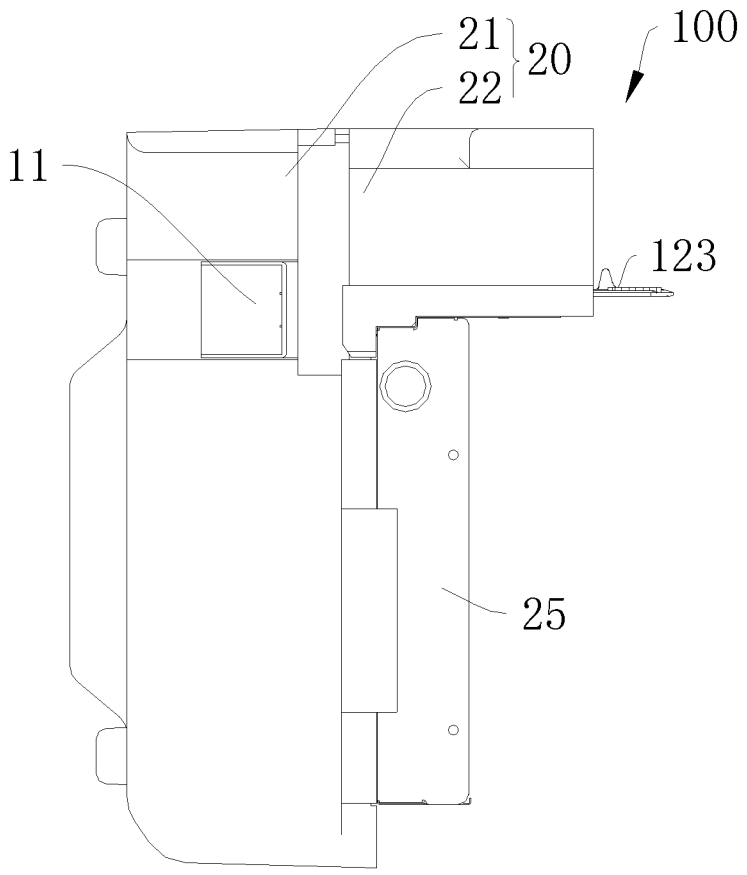
FIG. 8 is a side view of the air duct assembly according to one embodiment of the present application.
Figure 9:
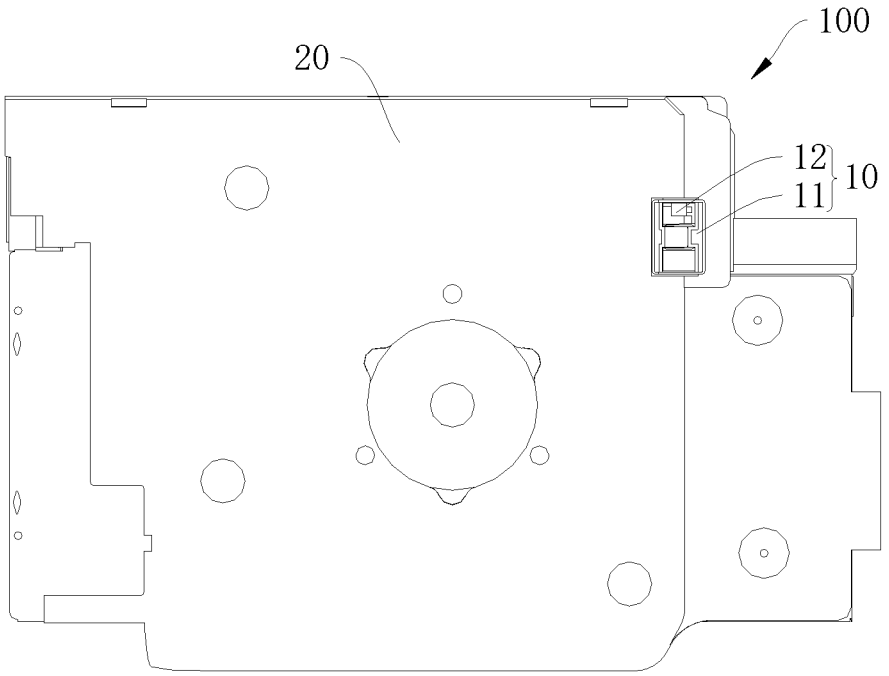
FIG. 9 is a rear view of the air duct assembly according to one embodiment of the present application.
Figure 10:
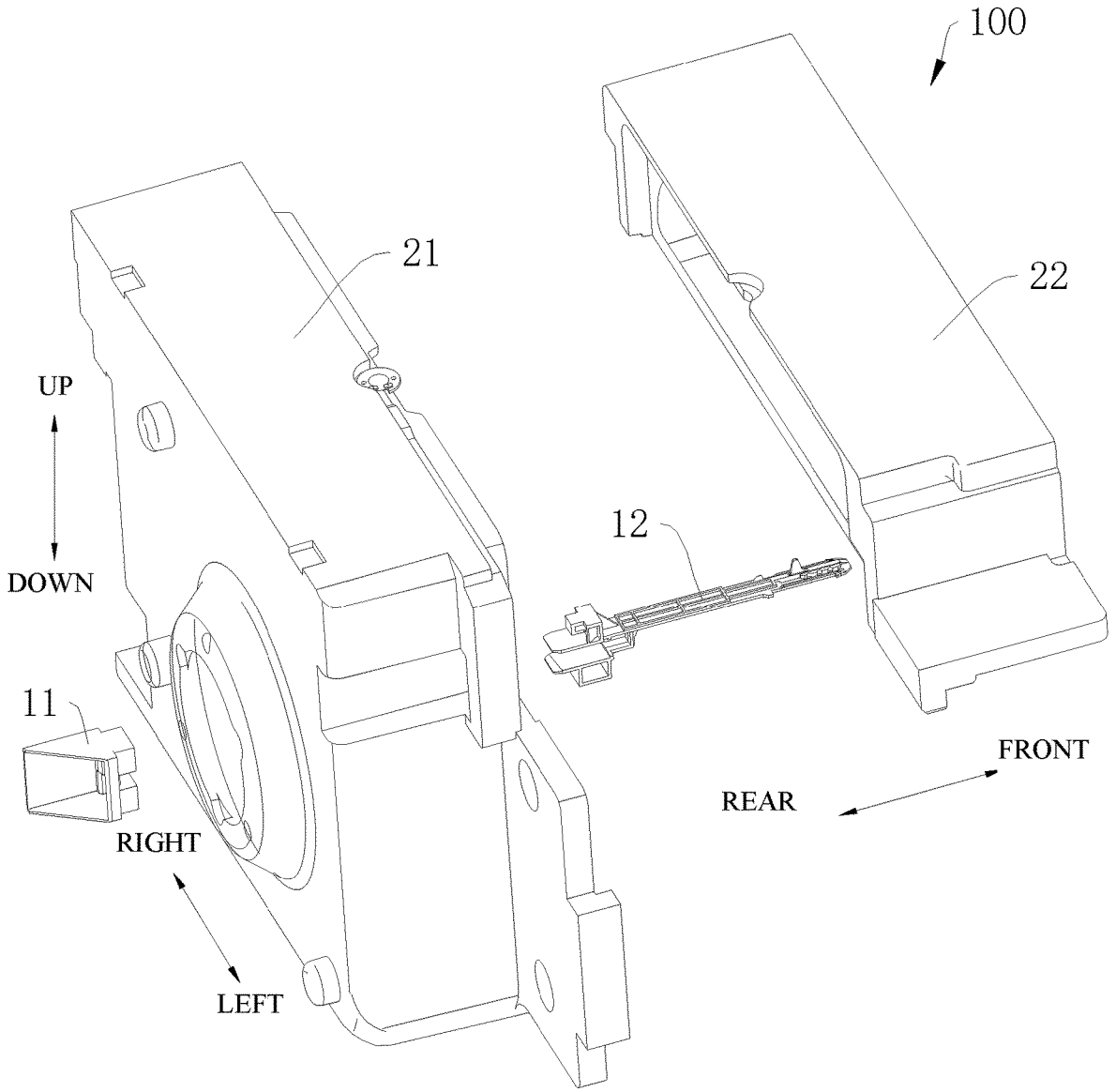
FIG. 10 is a schematic exploded diagram of the air duct assembly according to one embodiment of the present application.
Figure 11:
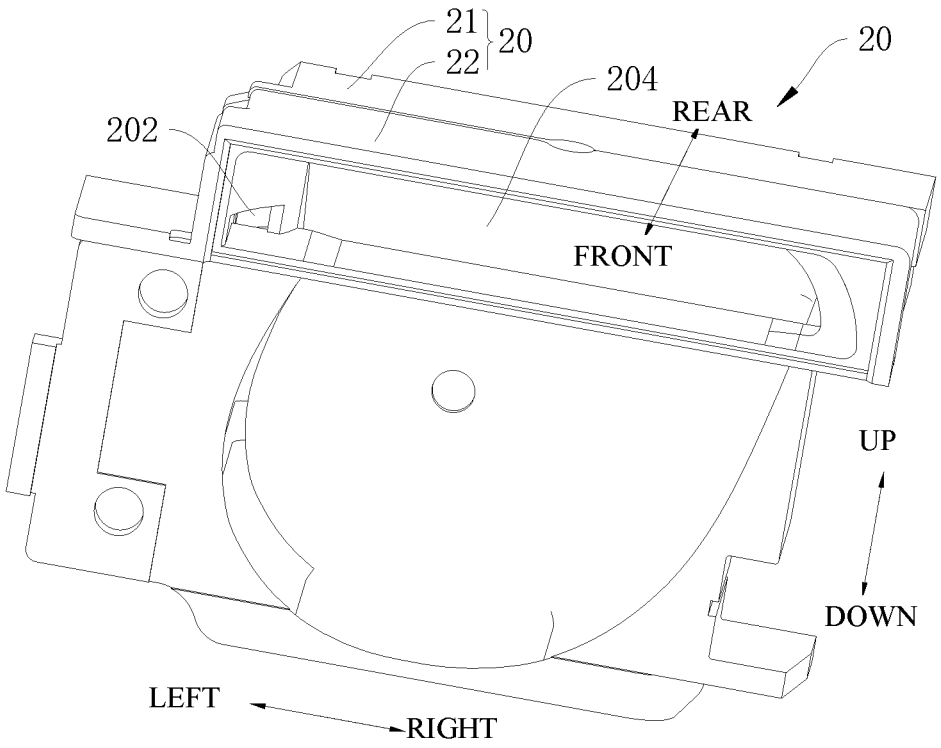
FIG. 11 is a schematic diagram of an air duct casing of the air duct assembly according to one embodiment of the present application.
Figure 12:
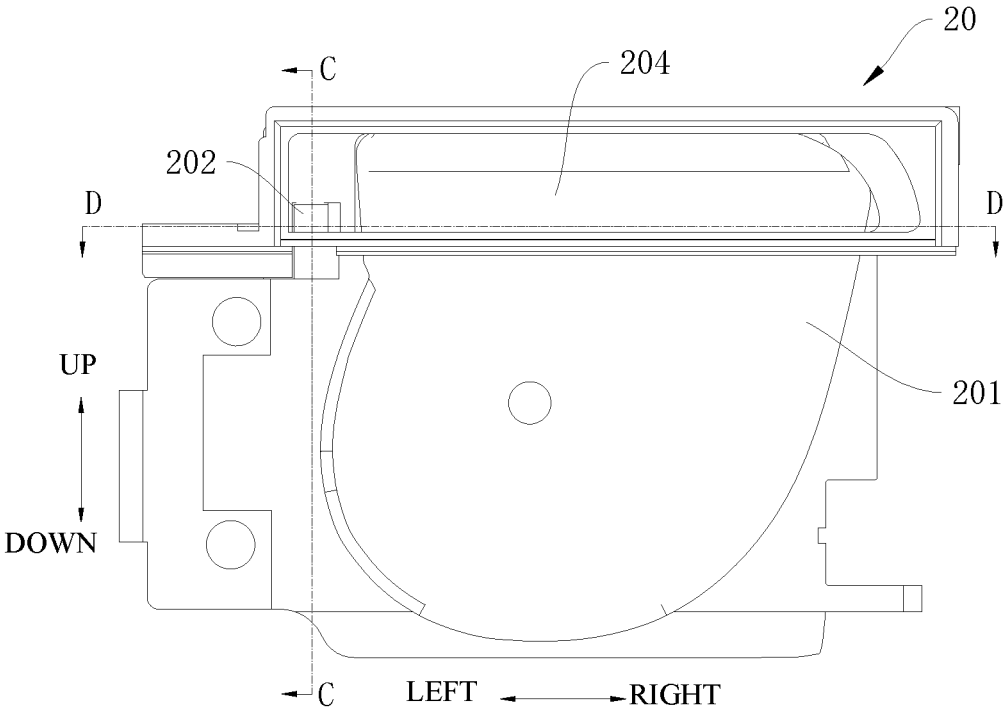
FIG. 12 is a front view of the air duct casing of the air duct assembly according to one embodiment of the present application.
Figure 13:
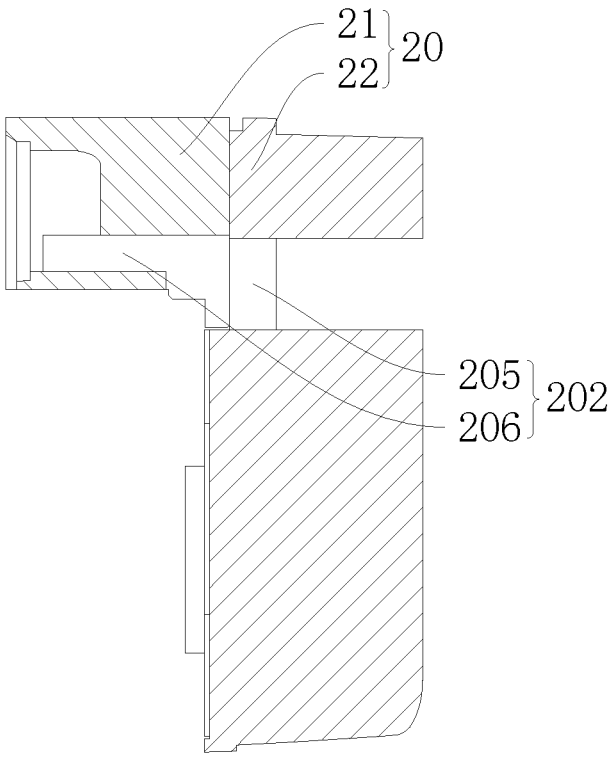
FIG. 13 is a cross-sectional view along line C-C in FIG. 12.
Figure 14:
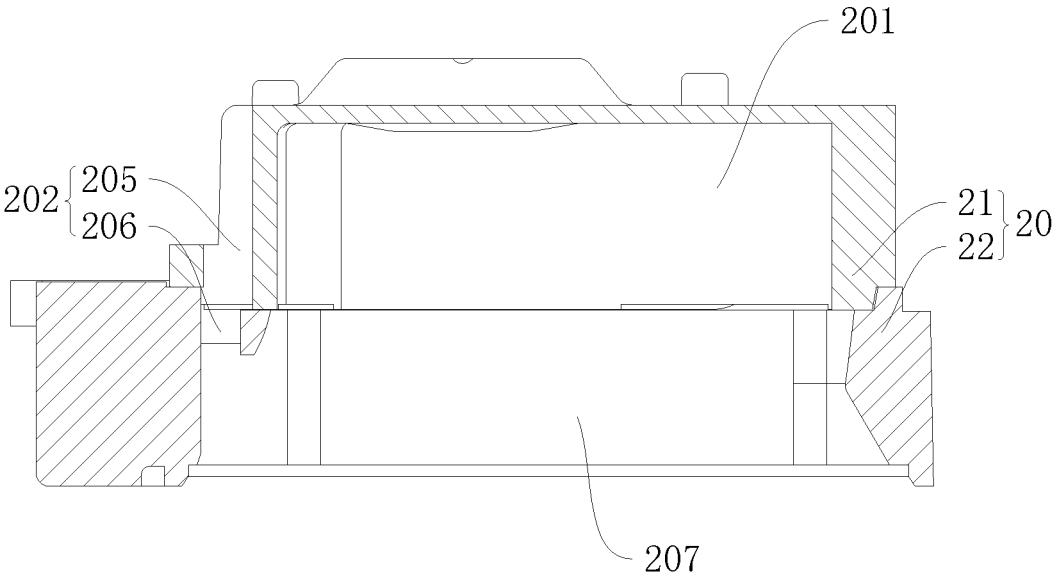
FIG. 14 is a cross-sectional view along line D-D in FIG. 12.
Figure 15:
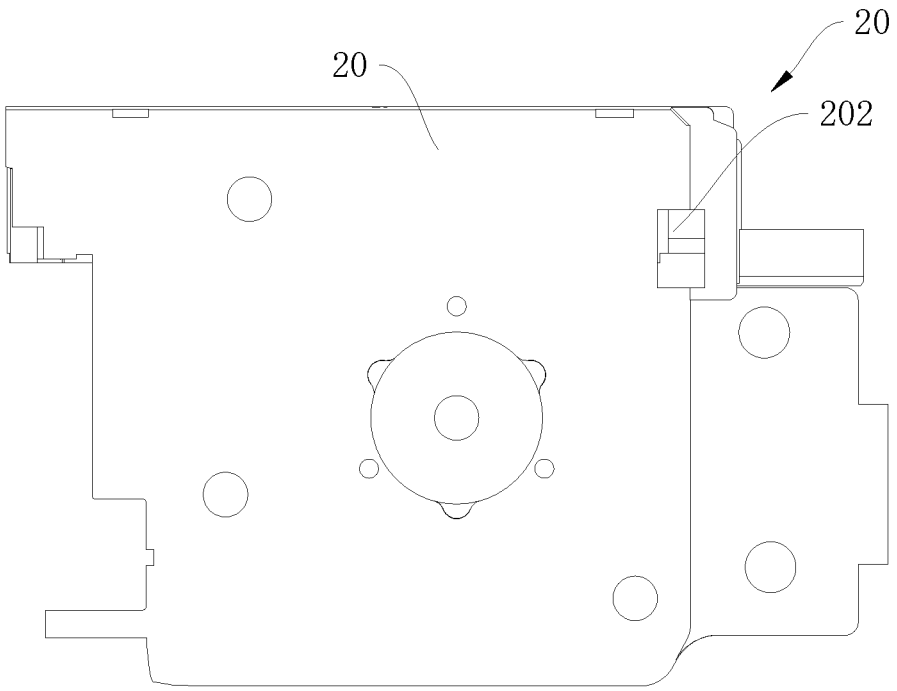
FIG. 15 is a rear view of the air duct assembly according to one embodiment of the present application.
Figure 16:
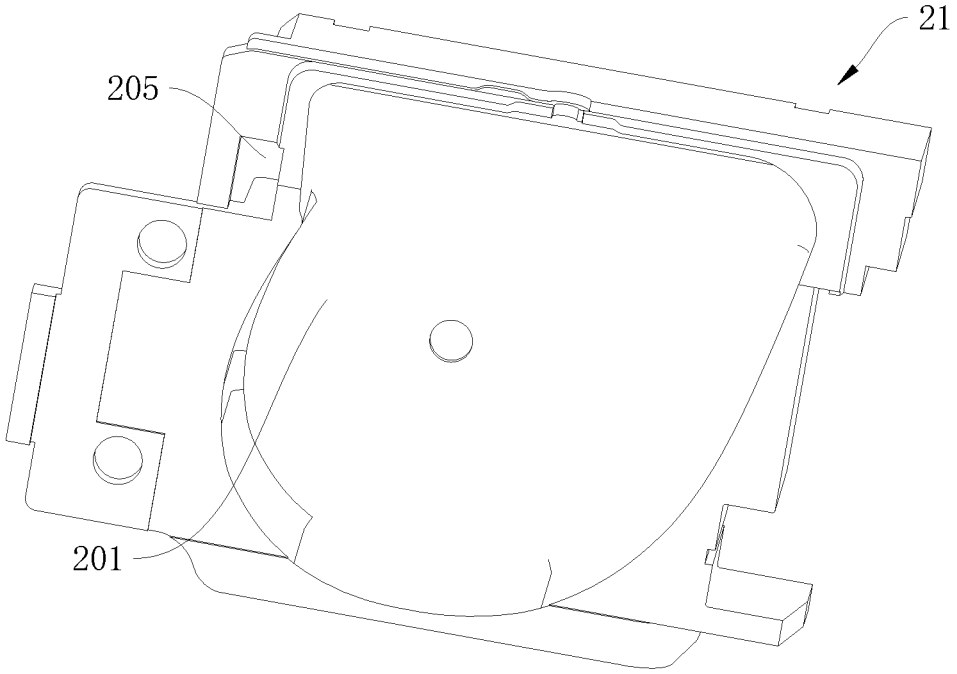
FIG. 16 is a schematic diagram of a rear air duct of the air duct assembly according to one embodiment of the present application.
Figure 17:
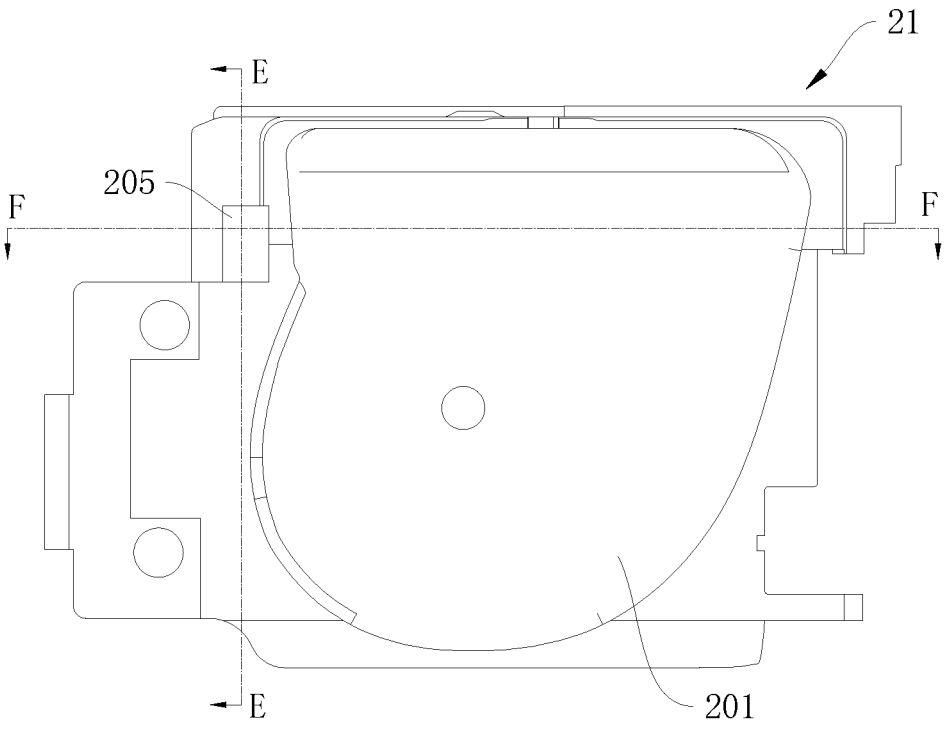
FIG. 17 is a front view of the rear air duct of the air duct assembly according to one embodiment of the present application.
Figure 18:
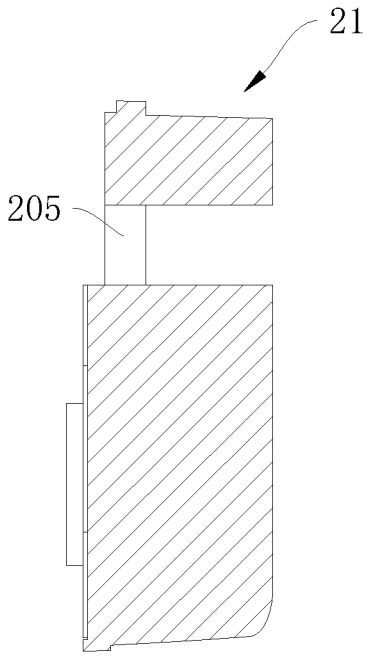
FIG. 18 is a cross-sectional view along line E-E in FIG. 17.
Figure 19:
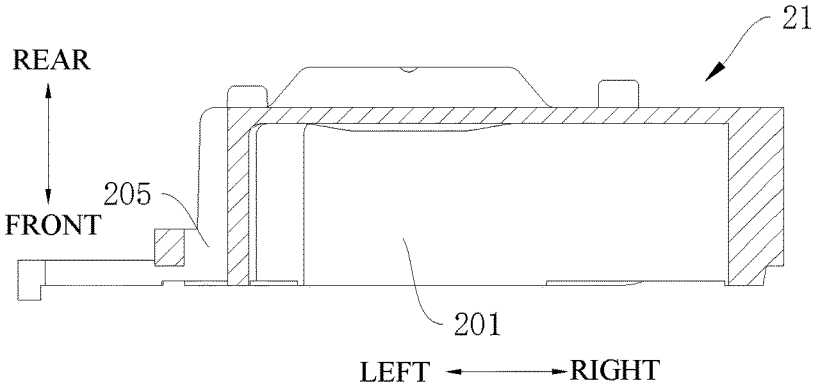
FIG. 19 is a cross-sectional view along line F-F in FIG. 17.
Figure 20:
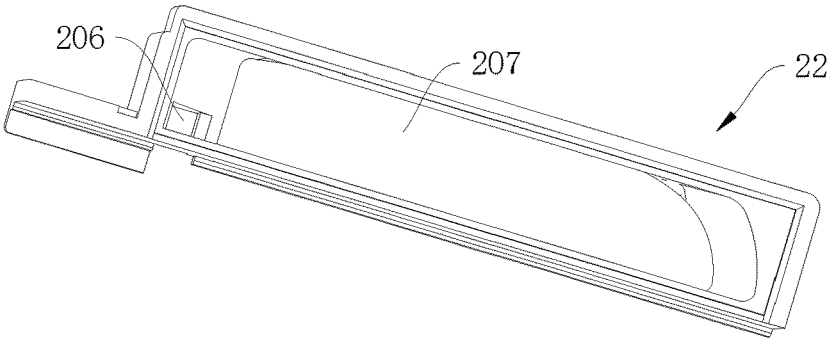
FIG. 20 is a schematic diagram of a front air duct of the air duct assembly according to one embodiment of the present application.
Figure 21:
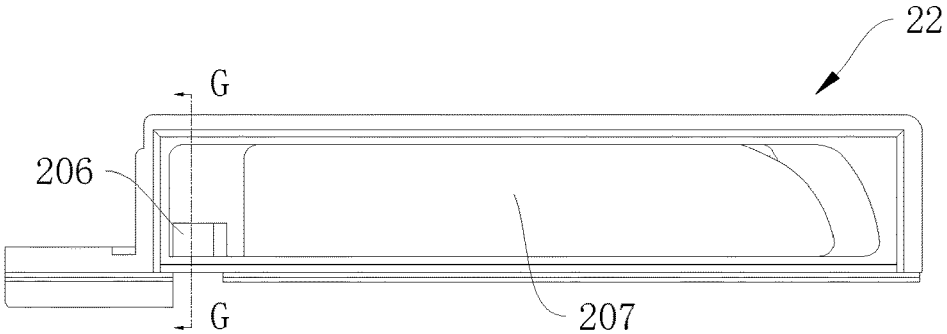
FIG. 21 is a front view of the front air duct of the air duct assembly according to one embodiment of the present application.
Figure 22:
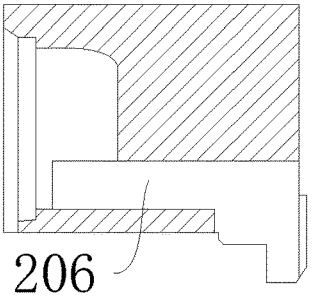
FIG. 22 is a cross-sectional view along line G-G in FIG. 21.

As shown in FIGS. 1 to 3, an opening and closing device 10 according to an embodiment of the present application includes: a door cover 11 configured to provide an air flow channel; and an opening and closing member 12 configured to open and close the air flow channel selectively.

Specifically, the door cover 11 is provided with a vent 101 for air flow to pass through. The vent 101 extends in a front and rear direction and has an opening that opens towards front, and the opening and closing member 12 is connected movably with the door cover 11 between an open position and a closed position, and configured to be suitable for being inserted to the door cover 11 from front to rear, e.g., through the opening of the vent 101 along an extension direction of the vent 101. The opening and closing member 12 includes an air door 121 configured to open and close the vent 101. The vent 101 is opened by the air door 121 (i.e., the air door 121 does not close the vent 101) when the opening and closing member 12 is at the open position and closed by the air door 121 when the opening and closing member 12 is at the closed position.

The opening and closing member 12 is suitable for being inserted to the door cover 11 from front to rear. That is, when mounted to the door cover 11 from front to rear, the opening and closing member 12 does not have an inelastic structure interfering with the door cover 11. In some embodiments, the opening and closing member 12 may be mounted to the door cover 11 from a front side of the door cover 11, and the opening and closing member 12 and the front side of the door cover 11 have separated projections from front to rear. In some embodiments, the opening and closing member 12 may be mounted to the door cover 11 from the front side of the door cover 11, and the opening and closing member 12 and the front side of the door cover 11 have a capacity of elastic deformation at a position with coincident projections from front to rear, so as to recede by means of the elastic deformation when the opening and closing member 12 is mounted.

In addition, the opening and closing member 12 may be inserted to the door cover 11, and thus a movement of the opening and closing member 12 may be guided by means of the insertion structure, which facilitates the smooth movement thereof.

In the opening and closing device 10 according to embodiments of the present application, with a modular design, the door cover 11, the opening and closing member 12, or the like are combined into the complete opening and closing device 10, and the modular design may simplify production and design of the opening and closing device 10, reduce an influence of the production and mounting thereof on a surrounding structure as well as an influence of the surrounding structure on the opening and closing device 10, and facilitate the production, assembly and design of the opening and closing device 10.

In addition, the opening and closing member 12 may be mounted to the door cover 11 from front to rear, and thus may be guided by the insertion structure. Further, an assembly process of the opening and closing device 10 is simplified, and an operating stability thereof is improved.

For example, when the opening and closing device 10 is applied to a fresh air duct 202 of an air conditioner 1000, that is, when the fresh air duct 202 is opened and closed by the opening and closing device 10, the door cover 11 may be nested at the fresh air duct 202. As such, the opening and closing member 12 may be mounted to the door cover 11 smoothly from front to rear, and there is no need to mount the opening and closing member 12 from a rear side of the fresh air duct 202, which may simplify a mounting process of the opening and closing device 10 and increase a mounting efficiency thereof and a space in the mounting process, thereby further simplifying the mounting process and increasing the mounting efficiency of the opening and closing device 10.

The opening and closing device 10 according to the present application may be applied to a wall mount air conditioner 1000, a cabinet air conditioner 1000, a portable air conditioner 1000, a window air conditioner, or the like.

Taking the window air conditioner as an example, the fresh air duct 202 is located at an indoor unit, an outdoor unit is located at a rear side of the indoor unit, and various pipelines or the outdoor unit may be located at the rear side of the fresh air duct 202, such that when the opening and closing member 12 is mounted from rear to front, a limited space is available for mounting the opening and closing member 12, which is prone to break or fail to mount the opening and closing member 12. With the opening and closing device 10 according to the present application, the opening and closing member 12 may be mounted from the front side of the door cover 11, and there is a sufficiently large mounting space, thus increasing an assembly efficiency effectively. Moreover, by means of inserted engagement, the opening and closing member 12 may be guided to a certain extent and guaranteed to be switched smoothly between the open position and the closed position.

In addition, the opening and closing member 12 may have many forms. For example, the vent 101 is opened and closed by a structure, and separate guide opening structure and guide insertion structure are provided to realize guiding. In some embodiments, a closing structure for opening and closing the vent 101 may be integrated with a guide structure in movable cooperation with the vent 101 to guide.

Optionally, the air door 121 includes a closing member 1211 and an insertion member 1212. The closing member 1211 is configured to be suitable for closing over and opening the vent 101; and the insertion member 1212 is connected with the closing member 1211 and suitable for being inserted into the vent 101 from front to rear and nested therein movably front and rear. A nested engagement between the insertion member 1212 and the vent 101 may guide the front and rear movement of the air door 121 as well as the movement of the air door 121 between the open position and closed position, which facilitates the air door 121 to move to a preset position along a preset track, thereby opening and closing the vent 101 smoothly by the air door 121.

In addition, the closing member 1211 may be formed into a form of cover plate 25, for example, a plate perpendicular to an axis of the vent 101 (i.e., a plate perpendicular to the front and rear direction). While moving front and rear, the closing member 1211 may close over the vent 101, and when being away from the vent 101, the closing member 1211 may open the vent 101.

Optionally, when the vent 101 is closed by the closing member 1211, the closing member 1211 may be inserted into the vent 101 to form a closed structure, or be closed over to form a closed structure with the outside of the vent 101.

Optionally, the insertion member 1212 includes: a first insert 1213 connected with the closing member 1211 and extending backwards (e.g., towards the door cover 11 or the vent 101); and a second insert 1214 connected with the closing member 1211 and extending backwards (e.g., towards the door cover 11 or the vent 101), where the first and second inserts 1213, 1214 are spaced apart from each other in a first direction (an up and down direction in the drawing) perpendicular to the front and rear direction. The first and second inserts 1213, 1214 may guide the front and rear movement of the air door 121. Since the first and second inserts 1213, 1214 are spaced apart from each other, a flow channel may be formed therebetween, and when the vent 101 is opened by the closing member 1211, the air flow may be guided to circulate through the flow channel formed between the first and second inserts 1213, 1214. That is, the opening and closing device 10 is adjusted into an open state.

Thus, the arrangement of the first and second inserts 1213, 1214 spaced apart from each other may guide the movement of the opening and closing member 12 while guiding the movement of the air door 121 effectively.

Optionally, the first and second inserts 1213, 1214 are inserted at two opposite sides in the vent 101 in the first direction respectively and are fitted to constrain a degree of freedom of the insertion member 1212 in the first direction, such that the insertion member may be moved front and rear stably, thereby further improving the guide function of the air door 121 and facilitating the stable movement thereof.

Optionally, a width of the first insert 1213 in a second direction (a left and right direction in the drawing) is equal to a width of the vent 101 in the second direction, and the second direction is perpendicular to the first direction and the front and rear direction. Because the widths of the first insert 1213 and the vent 101 equal each other, a degree of freedom of the first insert 1213 in the second direction is restrained, thereby increasing the stability of the front and rear movement of the insertion member.

Optionally, the second insert 1214 includes: a first portion 1215 connected with the closing member 1211 and extending backwards; and a second portion 1216 connected with the first portion 1215 and extending backwards, where a width of the first portion 1215 in the second direction is equal to the width of the vent 101 in the second direction, a width of the second portion 1216 in the second direction is less than the width of the vent 101 in the second direction, and the second direction is perpendicular to the first direction and the front and rear direction. The first portion 1215 of the second insert 1214 may also constrain the degree of freedom of the insertion member 1212 in the second direction, thereby guaranteeing the stable movement of the insertion member 1212. In addition, the arrangement of the second portion 1216 may reduce a space in the vent 101 occupied by the second insert 1214, increase a utilization rate of space, and reduce an influence of the insertion member 1212 on a rate of the air flow.

In addition, the arrangement of the second insert 1214 into the form of the first and second portions 1215, 1216 may adjust the space in the vent 101 occupied by the insertion member 1212, and the movement of the insertion member at different positions may adjust a flow area of the vent 101 and add a function of adjusting the rate of the air flow.

Optionally, the first insert 1213 has a shape of flat plate. The first insert 1213 may adjoin three adjacent inner side surfaces of the vent 101, which may increase the stability of guide for the insertion member 1212 effectively. Moreover, the first insert 1213 having the shape of flat plate may reduce the space thereof effectively and the influence on the rate of the air flow.

Optionally, the second insert 1214 has a shape of hollow tube extending in the second direction perpendicular to the first direction and the front and rear direction, which reduces and saves an amount of usage of a material of the opening and closing member 12. In addition, when the opening and closing member 12 is molded by means of injection, the second insert 1214 having the shape of hollow tube may avoid a problem of cold contraction and reduce poor injection.

Optionally, the door cover 11 further includes a guide opening 102 with an axis extending in the front and rear direction. The opening and closing member 12 further includes a guide member 122 suitable for being inserted into the guide opening 102 from front to rear, nested therein movably front and rear and connected with the air door 121. The arrangement of the guide opening 102 and the guide member 122 may further guide the opening and closing member 12, which facilitates the stable movement thereof. Moreover, guide structures including sliders and guide grooves may also be formed between the guide member 122 and the air door 121 and between the vent 101 and the guide opening 102 respectively, which further improves a guide effect on the opening and closing member 12.

Optionally, the door cover 11 has a shape of tube extending in the front and rear direction, and has an open rear end with a wedge-shaped structure, and the vent 101 and the guide opening 102 are spaced apart from each other at a front end of the door cover 11 in a direction perpendicular to the front and rear direction, which facilitates the mounting process of the door cover 11 and reduces the amount of usage of the material. Moreover, when the door cover 11 is mounted in the fresh air duct 202, the stability of the door cover 11 may be increased.

Optionally, the opening and closing member 12 is provided with a limit member 103 which abuts against the front side of the door cover 11 when the opening and closing member 12 is located at the closed position, and may be guided by the limit member 102, such that the opening and closing member 12 may be maintained at the closed position stably and prevented from being unavailable due to an excessive movement.

Optionally, the opening and closing device according to the above-mentioned embodiment of the present application includes the air door 121 and the guide member 122, and a step may be provided at an outer circumferential surface of at least one of the air door 121 or the guide member 122, thereby forming the limit member 103. For example, the steps may be provided at opposite surfaces of the air door 121 and the guide member 122 to form the limit members 103 which abut against the door cover 11 when the opening and closing member 12 is located at the closed position.

Further, a flange structure is provided at a periphery of at least one of the above-mentioned vent 101 or the guide opening 102, and the limit member 103 may abut against the flange structure when the opening and closing member 12 is located at the closed position. In addition, the arrangement of the flange structure may increase a structural strength of the door cover 11 effectively.

Optionally, the opening and closing member 12 further includes a pull rod 123 connected with the air door 121 and extending forwards. The opening and closing member 12 may be pulled by the pull rod 123, thereby switching the air door 121 between the closed position and the open position, and further simplifying operations.

In addition, a handle perpendicular to the pull rod 123 is provided at an end of the pull rod 123 apart from the door cover 11. The pull rod 123 may be pulled conveniently by the handle 124.

As shown in FIGS. 4 to 22, an air duct assembly 100 according to an embodiment of the present application includes an air duct casing 20 having an air circulation duct 201 and a fresh air duct 202 formed therein, and being provided with an air supply outlet 204 communicated with an air return inlet 203 of the air circulation duct 201. The air circulation duct 201 may serve as an air duct for circulating the air flow in a room, and the air flow is sucked into the air circulation duct 201 by suction of the air return inlet 203, subjected to heat exchange in the air circulation duct 201 and supplied out of the air supply outlet 204. Fresh air may be supplied into the room through the fresh air duct 202 to improve an indoor air environment.

The air duct assembly 100 may further include a fan wheel 23 provided at the air circulation duct 203 and configured to drive the air flow to flow to the air supply outlet 204 from the air return inlet 203, thereby forming circulating heat exchange from the interior of the room to the air return inlet 203, to the air circulation duct 201 (which may include a heat exchanger 300), to the air supply outlet 204, and to the interior of the room, and improving the indoor environment. The air circulation duct 201 may be provided therein with a heat exchanger which may change an indoor temperature, or a purifying device which may improve the indoor air quality, or the like.

The air duct assembly 100 may further include an opening and closing device 10 mounted to the air duct casing 20 and configured to open and close the fresh air duct 202.

Optionally, the opening and closing device 10 is the opening and closing device according to embodiments of the present application.

In the air duct assembly 100 according to embodiments of the present application, by providing the above-mentioned opening and closing device 10, the opening and closing device 10 may be conveniently mounted rapidly, and the mounting efficiency thereof may be increased. Since the opening and closing member 12 is mounted from front to rear, the air duct assembly 100 may be mounted conveniently, the mounting space may be increased, and a difficulty of the mounting process may be simplified.

Certainly, an opening and closing device 10 in other forms may also be adopted to open and close an air flow duct.

Optionally, the door cover 11 is nested at the fresh air duct 202, and the opening and closing member 12 is suitable for being mounted to the door cover 11 from front to rear. That is, after the door cover 11 is nested at the fresh air duct 202, the opening and closing member 12 may be mounted to the door cover 11 from front to rear, thus further simplifying the mounting process of the opening and closing device 10 and the assembly process.

The air duct assembly 100 may further include an air outlet frame 24. The air outlet frame 24 may be connected with the air duct casing 20, opposite to the air supply outlet 204, and configured to guide the air flow supplied out of the air supply outlet 204 to a preset position. In addition, the air outlet frame 24 may further have a protection function to prevent an external impurity or hand, or the like, from entering the air circulation duct 201, thus reducing a potential safety hazard.

Optionally, the opening and closing device 10 may include a pull rod 123 extending close to the air outlet frame 24 but not extending out thereof. When in use, the opening and closing member 12 may be driven to move after the air outlet frame 24 is taken down, thereby opening and closing the fresh air duct 202. When the air outlet frame 24 is not taken down, opening and closing states of the fresh air duct 202 are adjusted difficultly, thus avoiding a misoperation.

For example, when the air duct assembly 100 (or the air conditioner 1000 according to the present application) is applied to such a public place as a hotel, or the like, the opening and closing device 10 open to the public to operate is easily damaged due to an excessive adjustment. Thus, in the present application, the arrangement of the pull rod 123 behind the air outlet frame 24 may avoid the damage caused by misadjustment or random adjustment of the opening and closing device 10.

In addition, in other embodiments of the present application, the pull rod 123 is connected with the air vent and extends forwards.

In addition, a handle 124 perpendicular to the pull rod 123 is provided at an end of the pull rod 123 close to the air outlet frame 24. In other embodiments of the present application, the end of the pull rod 123 close to the air outlet frame 24 is the end thereof apart from the door cover 11.

Optionally, the air duct casing 20 includes: a rear air duct 21 provided with a fresh air inlet 205 and the air circulation duct 201; a front air duct 22 provided at a front side of the rear air duct 21 and provided with a fresh air outlet 206 and an air guide opening 207, where the fresh air outlet 206 and the fresh air inlet 205 are opposite front and rear and configure the fresh air duct 202, and the air guide opening 207 and an air outlet end of the air circulation duct 201 are opposite front and rear and configure the air supply outlet 204. The combination of the front and rear air ducts 21 may reduce a difficulty in producing the air duct casing, facilitate a molding process of the air duct cast 20 and increase a molding efficiency.

Optionally, the opening and closing device 10 according to the present application may be provided in the fresh air inlet 205 at least partially and configured to open the fresh air inlet 205, thus facilitating the mounting process of the opening and closing device 10. Moreover, in conjunction with the following description, the fresh air inlet 205 has a greater flow area than the fresh air outlet 206, thereby facilitating the mounting process of the opening and closing device 10.

Optionally, the opening and closing device 10 may be configured to be suitable for being mounted into the fresh air inlet 205 from a front side of the fresh air inlet 205, thereby facilitating the mounting process of the opening and closing device 10.

In conjunction with the opening and closing device 10 according to other embodiments of the present application, the door cover 11 may be nested at the fresh air inlet 205, and the opening and closing member 12 is suitable for being mounted to the door cover 11 from front to rear. Thus, in the present application, the fresh air duct 202 and the air supply outlet 204 may be provided to extend in the front and rear direction, such that a fresh air opening may be formed into the air supply outlet 204 conveniently, thereby being driven by the fan wheel 23 to introduce fresh air. In addition, the opening and closing member 12 may be mounted and moved in the front and rear direction conveniently, and the fresh air duct 202 may be opened and closed conveniently.

Optionally, the opening and closing member 12 abuts against a rear side of the front air duct 22 at the open position. The opening and closing member 12 may be limited by the front air duct 22, which avoids the opening and closing member 12 being pulled out of the door cover 11, and reduces a failure rate of the opening and closing device 10.

Optionally, the air duct casing further includes a cover plate 25 covering the front side of the rear air duct 21 to close over the air circulation duct 201, and the air return inlet 203 is formed at the cover plate 25. The complete air circulation duct 201 may be formed by a combination of the cover plate 25.

In the above-mentioned embodiments, the flow area of the fresh air outlet 206 may be set to be smaller than that of the fresh air inlet 205, such that a negative pressure may be generated at the fresh air outlet 206 more easily, and the air flow may be introduced into the fresh air duct 202 and supplied into the room conveniently. Moreover, the fresh air inlet 205 having the greater flow area may provide more fresh air, which increases a delivery efficiency of the fresh air.

Optionally, the fresh air duct 202 may be communicated with the air supply outlet 204. In an operating process, the air flow is supplied out of the air supply outlet 204 and may also be guided to pass through the fresh air duct 202 to be supplied into the room, thereby supplying the fresh air into the room through the fresh air duct 202.

In addition, in order to conveniently supply the fresh air into the room through the fresh air duct 202 stably, the negative pressure formed at an outlet of the fresh air duct 202 may be increased in the operating process, thereby introducing the fresh air into the room more conveniently. In the present application, the negative pressure at the outlet of the fresh air duct 202 may be increased in plural different ways, at least including the formation of the negative pressure by a structure and the provision of the negative pressure by rotation of the fan wheel 23.

Optionally, a bottom surface of the air supply outlet 204 includes a first step surface 208, a second step surface 209 and a connection surface 2010 connected between the first and second step surfaces 208, 209, where the first step surface 208 is higher than the second step surface 209 to form a step, and the outlet of the fresh air duct 202 is provided at the first step surface 208. Thus, in the operating process (of the air conditioner 1000 or other equipment), an air flow path from an air return duct to the air supply outlet 204 may be formed by the air circulation duct 201, and the arrangement of the step structure at the air supply outlet 204 may increase the negative pressure formed at the step and facilitate introduction of the fresh air into the room from the air flow duct.

Advantageously, the step may be set to be higher than the air circulation duct 201.

In addition, in order to further increase the negative pressure, in the present application, the above-mentioned first step surface 208 is configured into a shape of arc surface with a depth reduced gradually in a direction apart from the second step surface 209, thus further improving the negative pressure effect at the first step surface 208 and increasing suction to the air flow in the fresh air duct 202 effectively and a volume of the fresh air.

Optionally, in the present application, the negative pressure may be formed at the outlet of the fresh air duct 202 by changing the structure of the air circulation duct 201. For example, the air circulation duct 201 is configured to slant from the air return inlet 203 to the air supply outlet 204 in a direction apart from the fresh air duct 202. Thus, in the operating process, the air flow will be delivered in a direction deviated from the fresh air duct 202 when delivered from the air return inlet 203 to the air supply outlet 204, such that the negative pressure may be formed at a side opposite to the delivery direction thereof, i.e., a position where the fresh air duct 202 is located, thereby improving the effect of the negative pressure effectively.

In order to further improve the generation effect of the negative pressure, a rotation direction of the fan wheel 23 may be changed. For example, the fan wheel 23 is configured to be rotated in a direction from the air return inlet 203 to the air supply outlet 204 in a direction apart from the fresh air duct 202. Thus, when the fan wheel 23 is rotated, the air flow will be delivered from the air return inlet 203 to the air supply outlet 204 in the direction apart from the fresh air duct 202, thus further improving the effect of the negative pressure at the fresh air duct 202.

Optionally, in the present application, the fresh air duct 202 penetrates through the air duct casing 20 in the front and rear direction. Thus, the fresh air may be supplied into the room through the fresh air duct 202 from rear to front smoothly, and has a simple running track in the fresh air duct 202, which avoids an energy loss possibly generated when a direction of the air duct is changed.

The air circulation duct 201 extends in a longitudinal direction (referring to the up and down direction in the drawing), the air supply outlet 204 has a closed rear side and an open front side for supplying the air. That is, the air supply outlet 204 is configured to supply the air forwards. The air supply outlet 204 is configured into a shape extending in a transverse direction (referring to a left and right direction in the drawing), thereby supplying air in a large range. The fresh air duct 202 is arranged at an end of the air supply outlet 204 in the transverse direction, thereby facilitating formation of the negative pressure at the fresh air duct 202, and improving the generation effect of the negative pressure effectively.

The transverse direction, the longitudinal direction and the front and rear directions are perpendicular to one another.

Figure 23:
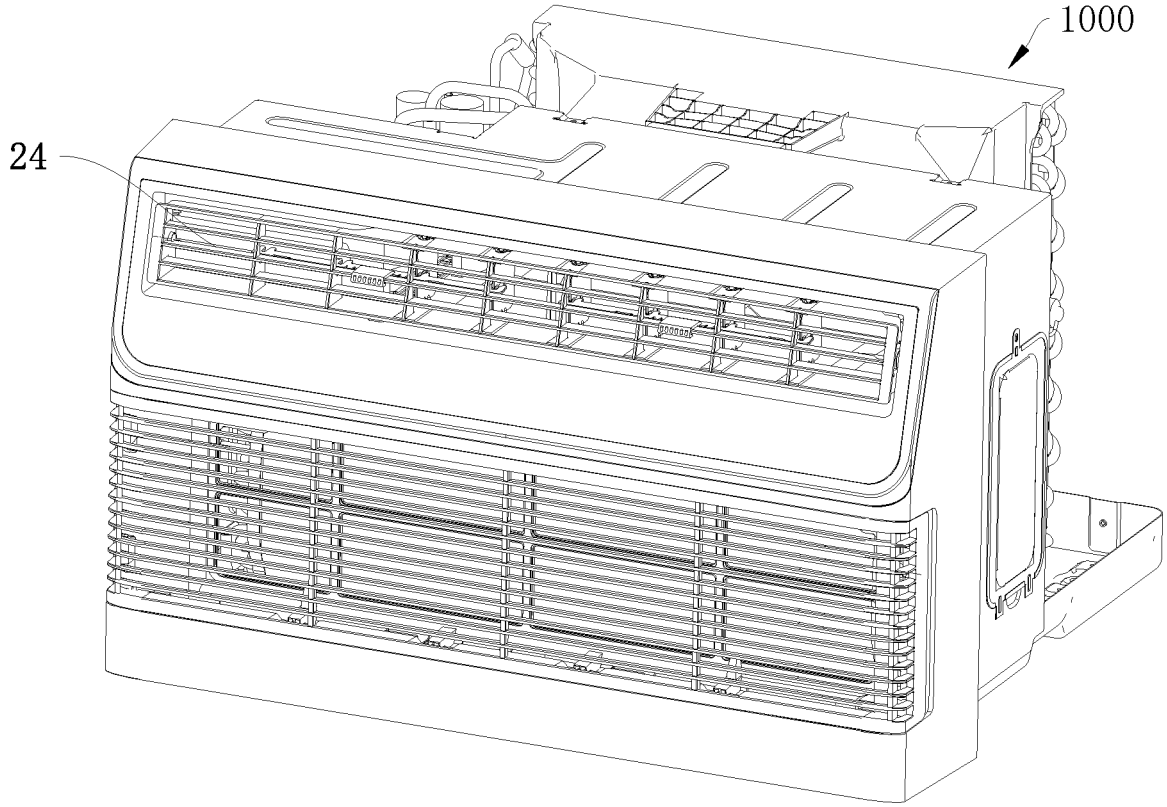
FIG. 23 is a schematic diagram of an air conditioner according to one embodiment of the present application.
Figure 24:
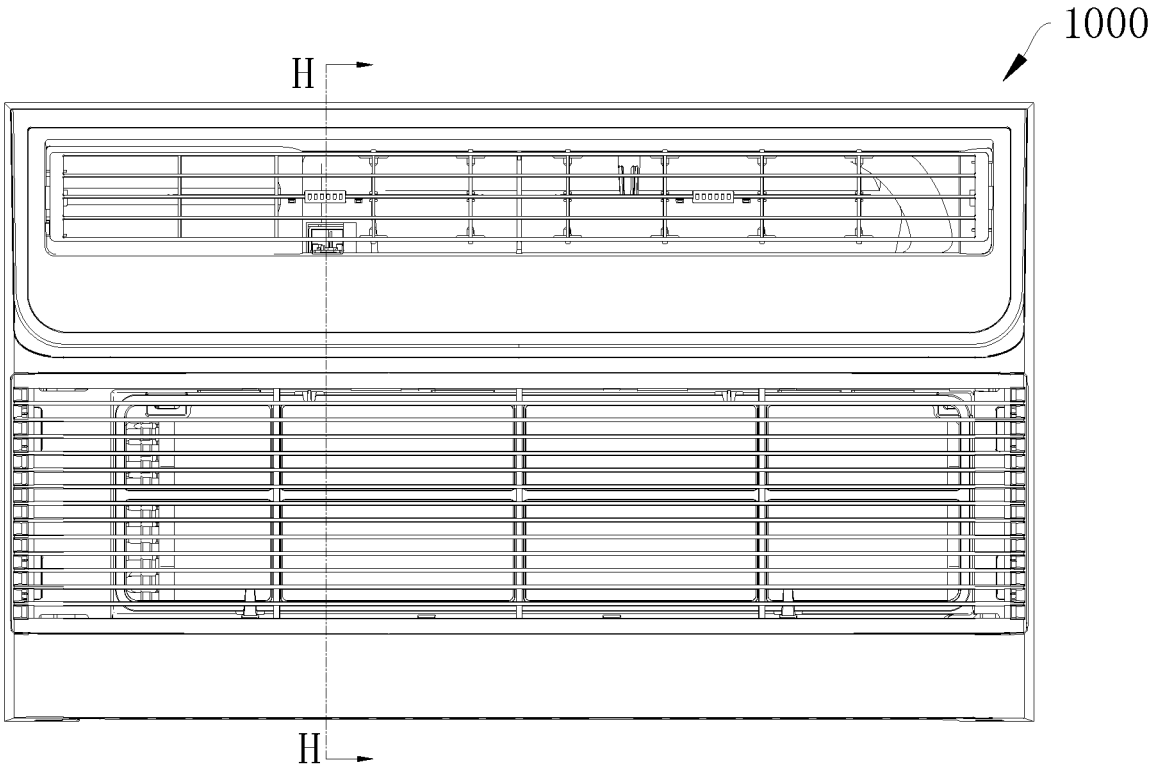
FIG. 24 is a front view of the air conditioner according to one embodiment of the present application.
Figure 25:
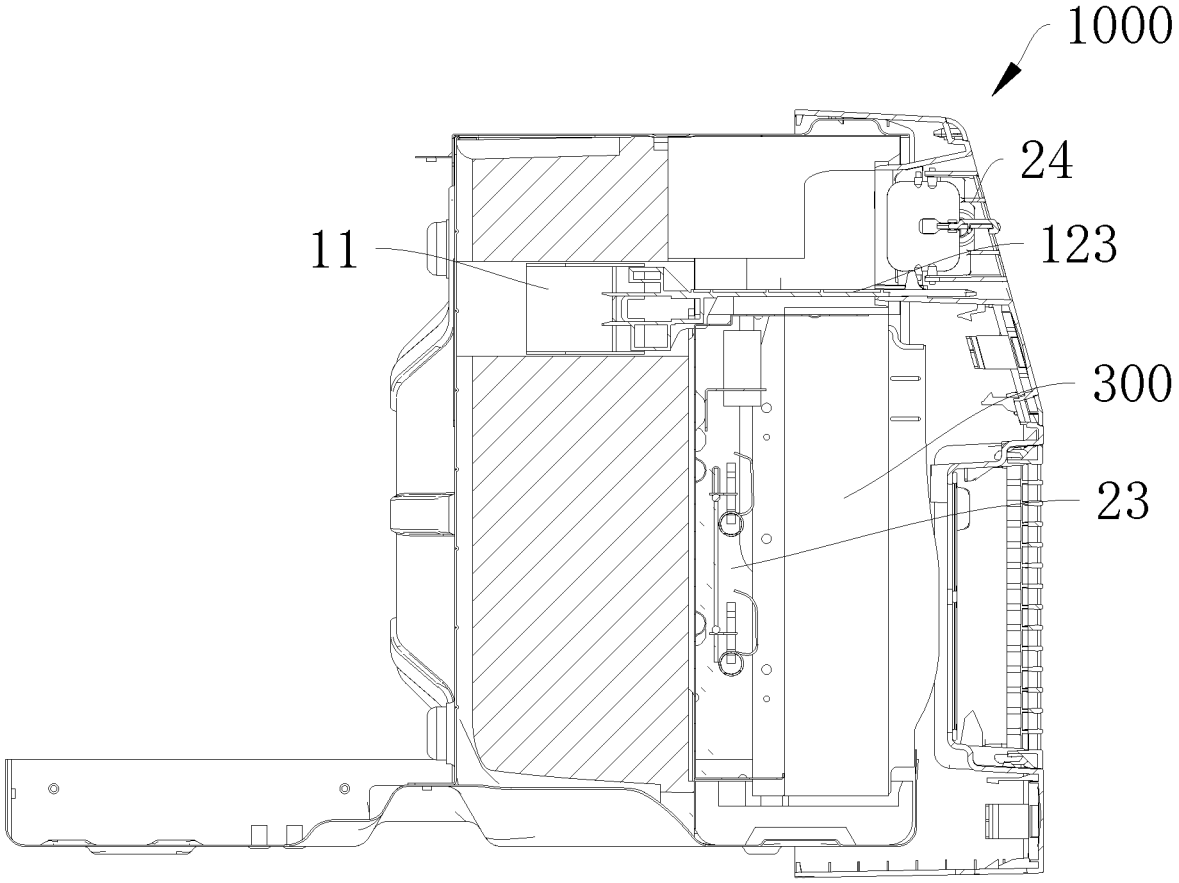
FIG. 25 is a cross-sectional view along line H-H in FIG. 24.

As shown in FIGS. 23 to 25, an air conditioner 1000 according to an embodiment of the present application includes: the above-mentioned air duct assembly 100; and a heat exchanger 300 provided at the air circulation duct 201.

In the air conditioner 1000 according to embodiments of the present application, the fresh air may or may not be introduced selectively, and the simple assembly may still be implemented after a fresh air introducing structure is added.

Optionally, the opening and closing member 12 abuts against a rear side of the heat exchanger 300 at the open position, which maintains the stability of the opening and closing member 12 and avoids the opening and closing member 12 from being pulled out of the door cover 11.

In the present application, the opening and closing member 12 of the opening and closing device 10 may be mounted from the front side of the fresh air duct, thus improving the production efficiency. Further, the pull rod 123 of the opening and closing member 123 is hidden by the air outlet frame 24 after mounted, and specifically, a front end of the pull rod 123 is hidden behind or in the air outlet frame 24 and does not extend out of the air outlet frame 24. In addition, the handle 124 protrudes from the pull rod 123, and the air door 121 may be shifted using the handle 124.

In the description of the present application, it is to be understood that terms such as "center," "longitudinal," "transverse," "length," "width," "thickness," "upper," "lower," "front," "rear," "left," "right," "vertical," "horizontal," "top," "bottom," "inner," "outer," "clockwise," "anticlockwise," "axial," "radial," and "circumferential" should be construed to refer to the orientation as then described or as shown in the drawings under discussion. These relative terms are for convenience of description and do not require that the present application be constructed or operated in a particular orientation, thus cannot be construed to limit the present application.

In addition, terms of "first," "second" are merely for description, but shall not be understood as indication or implication of relative importance or implicit indication of the number of the specific technical features. Therefore, the feature defined with "first" and "second" may include at least one feature explicitly or implicitly. In the description of the present disclosure, "a plurality of" means at least two, for example, two, three, or the like, unless otherwise stated.

In the present application, unless specified or limited otherwise, the terms "mounted," "connected," "coupled," "fixed" and the like are used broadly, and may be, for example, fixed connections, detachable connections, or integral connections; may also be mechanical connections or electrical connections; may also be direct connections or indirect connections via intervening structures; may also be inner communications of two elements, or interactions between two elements. The above terms can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

In the description of the present specification, reference throughout this specification to "an embodiment," "some embodiments," "exemplary embodiment," "example," "specific example" or "some examples" means that a particular feature, structure, material, or characteristic described in connection with the embodiment or example is included in at least one embodiment or example of the present disclosure. In the specification, the schematic expressions to the above-mentioned terms are not necessarily referring to the same embodiment or example. Furthermore, the described particular features, structures, materials, or characteristics may be combined in any suitable manner in one or more embodiments or examples. Furthermore, those skilled in the art may combine different embodiments or examples and different embodiments or features in the examples described in the specification, without mutual contradictions.

Although embodiments of the present disclosure have been shown and illustrated, it shall be understood that the above-mentioned embodiments are exemplary and not construed as limitations to the present disclosure. Various changes, modifications, alternatives and variants within the scope of the present disclosure may be made by those skilled in the art.

What is claimed is:

1. An opening and closing device comprising: a door cover including a vent; and an opening and closing member configured to be inserted into the door cover through an opening of the vent along an extension direction of the vent, the opening and closing member including an air door and being movable between: an open position at which the air door does not close the vent, and a closed position at which the air door closes the vent, wherein the air door includes: a closing member configured to close over and open the vent; and an insertion member connected with the closing member and configured to be inserted into the vent and movably nested in the vent, the insertion member including two inserts connected with the closing member, the two inserts extending toward the door cover, and one of the two inserts having a hollow tube shape.

2. The opening and closing device according to claim 1, wherein the two inserts include:

a first insert and a second insert spaced apart from each other in a perpendicular direction perpendicular to the extension direction of the vent.

3. The opening and closing device according to claim 2, wherein the first insert and the second insert are inserted at two opposite sides in the vent in the perpendicular direction.

4. The opening and closing device according to claim 2, wherein:

the perpendicular direction is a first perpendicular direction; and a width of the first insert in a second perpendicular direction is equal to a width of the vent in the second perpendicular direction, the second perpendicular direction being perpendicular to the first perpendicular direction and the extension direction of the vent.

5. The opening and closing device according to claim 2, wherein:

the perpendicular direction is a first perpendicular direction; and the second insert includes:

a first portion connected with the closing member and extending towards the door cover, a width of the first portion in a second perpendicular direction is equal to a width of the vent in the second perpendicular direction, the second perpendicular direction being perpendicular to the first perpendicular direction and the extension direction of the vent; and a second portion connected with the first portion and extending towards the door cover, a width of the second portion in the second perpendicular direction being less than the width of the vent in the second perpendicular direction.

6. The opening and closing device according to claim 2, wherein:

the perpendicular direction is a first perpendicular direction;

the first insert has a flat plate shape;

the second insert has the hollow tube shape extending in a second perpendicular direction perpendicular to the first perpendicular direction and the extension direction of the vent.

7. The opening and closing device according to claim 1, wherein:

the door cover further includes a guide opening, an extension direction of the guide opening being parallel to the extension direction of the vent; and the opening and closing member further includes a guide member configured to be inserted into the guide opening along the extension direction of the guide opening and movably nested in the guide opening.

8. The opening and closing device according to claim 7, wherein:

the vent and the guide opening are provided at a front end of the door cover and are spaced apart from each other in a direction perpendicular to the extension direction of the vent; and a rear end of the door cover is open and has a wedge-shaped structure.

9. The opening and closing device according to claim 1, wherein the opening and closing member further includes a limit member configured to abut against a front side of the door cover when the opening and closing member is located at the closed position.

10. The opening and closing device according to claim 1, wherein the opening and closing member further includes a pull rod connected with the air door and extending away from the door cover, an end of the pull rod away from the door cover including a handle perpendicular to the pull rod.

11. An air duct assembly comprising: an air duct casing, an air circulation duct and a fresh air duct being formed in the air duct casing, and the air duct casing including an air supply outlet in communication with an air return inlet of the air circulation duct; a fan wheel provided in the air circulation duct; and an opening and closing device mounted at the air duct casing and configured to open and close the fresh air duct, the opening and closing device including: a door cover including a vent; and an opening and closing member configured to be inserted into the door cover through an opening of the vent along an extension direction of the vent, the opening and closing member including an air door and being movable between: an open position at which the air door does not close the vent, and a closed position at which the air door closes the vent; wherein the air door includes: a closing member configured to close over and open the vent; and an insertion member connected with the closing member and configured to be inserted into the vent and movably nested in the vent, the insertion member including two inserts connected with the closing member, the two inserts extending toward the door cover, and one of the two inserts having a hollow tube shape.

12. The air duct assembly according to claim 11, wherein a bottom surface of the air supply outlet includes a first step surface, a second step surface, and a connection surface connecting the first step surface and the second step surface, the first step surface and the second step surface being not on a same plane, and an outlet of the fresh air duct being provided at the first step surface.

13. The air duct assembly according to claim 11, wherein the door cover is nested in the fresh air duct.

14. The air duct assembly according to claim 11, wherein:

the air duct casing includes:

a rear air duct including a fresh air inlet and the air circulation duct; and a front air duct provided at a front side of the rear air duct and including a fresh air outlet opposite to the fresh air inlet in a front and rear direction, the fresh air duct including the fresh air inlet and the fresh air outlet; and at least a part of the opening and closing device is provided in the fresh air inlet to open and close the fresh air inlet.

15. The air duct assembly according to claim 14, wherein the opening and closing device is configured to be mounted into the fresh air inlet from a front side of the fresh air inlet.

16. The air duct assembly according to claim 14, wherein the door cover is nested in the fresh air inlet, and the opening and closing member is mounted to the door cover from front to rear.

17. The air duct assembly according to claim 14, wherein the opening and closing member in the open position abuts against a rear side of the front air duct.

18. The air duct assembly according to claim 11, further comprising:

an air outlet frame connected with the air duct casing and opposite to the air supply outlet;

wherein the opening and closing device includes a pull rod extending to be adjacent to the air outlet frame but not extending out of the air outlet frame, the pull rod including a handle perpendicular to the pull rod at an end of the pull rod proximal to the air outlet frame.

19. An air conditioner comprising: an air duct assembly including: an air duct casing, an air circulation duct and a fresh air duct being formed in the air duct casing, and the air duct casing including an air supply outlet in communication with an air return inlet of the air circulation duct; a fan wheel provided in the air circulation duct; and an opening and closing device mounted at the air duct casing and configured to open and close the fresh air duct, the opening and closing device including: a door cover including a vent; and an opening and closing member configured to be inserted into the door cover through an opening of the vent along an extension direction of the vent, the opening and closing member including an air door and being movable between: an open position at which the air door does not close the vent, and a closed position at which the air door closes the vent; and a heat exchanger provided in the air circulation duct, wherein the air door includes: a closing member configured to close over and open the vent; and an insertion member connected with the closing member and configured to be inserted into the vent and movably nested in the vent, the insertion member including two inserts connected with the closing member, the two inserts extending toward the door cover, and one of the two inserts having a hollow tube shape.

* * * * *